US006575562B1

(12) United States Patent
Anderson et al.

(10) Patent No.: US 6,575,562 B1
(45) Date of Patent: Jun. 10, 2003

(54) PERFORMANCE INKJET PRINTHEAD CHIP LAYOUTS AND ASSEMBLIES

(75) Inventors: Frank Edward Anderson, Sadieville, KY (US); Bruce David Gibson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/440,730

(22) Filed: Nov. 16, 1999

(51) Int. Cl.[7] ..... B41J 2/14
(52) U.S. Cl. ..... 347/58; 347/59
(58) Field of Search ..... 347/20, 54, 56, 347/57, 58, 59, 200

(56) References Cited

U.S. PATENT DOCUMENTS 4,601,777 A * 7/1986 Hawkins et al. ..... 347/56
4,611,219 A 9/1986 Sugitani et al.
4,633,274 A * 12/1986 Matsuda ..... 347/50
4,651,164 A * 3/1987 Abe et al. ..... 347/209
4,789,425 A * 12/1988 Drake et al. ..... 347/57
4,942,408 A 7/1990 Braun
4,947,192 A * 8/1990 Hawkins et al. ..... 347/56
4,949,102 A 8/1990 Braun
4,985,710 A 1/1991 Drake et al.
4,990,935 A * 2/1991 Takemoto et al. ..... 347/200
5,148,185 A 9/1992 Abe et al.
5,150,132 A 9/1992 Shimomura et al.
5,194,877 A 3/1993 Lam et al.
5,558,975 A 9/1996 Noguchi et al.
5,648,804 A 7/1997 Keefe et al.
5,666,140 A 9/1997 Mitani et al.
5,685,074 A 11/1997 Pan et al.
5,697,144 A 12/1997 Mitani et al.
6,132,032 A * 10/2000 Bryant et al. ..... 347/59
6,176,569 B1 * 1/2001 Anderson et al. ..... 347/57

* cited by examiner

*Primary Examiner*—Huan Tran
(74) *Attorney, Agent, or Firm*—Dinsmore & Shohl LLP

(57) ABSTRACT

Inkjet printhead chips comprise a substrate, a plurality of transducers, a plurality of interconnects and driver circuitry capable of electrically connecting the transducers and the interconnects. The substrate has a surface with opposing first and second edges, with a plurality of transducers arranged along the first edge and a plurality of interconnects arranged along the second edge. The driver circuitry is arranged on the substrate. The printhead chips can also be included in inkjet printhead chip assemblies wherein the printhead chip is arranged on a print surface of a body, and wherein the print surface is capable of being arranged generally parallel to a surface of a print-receiving medium. In this embodiment, an edgefeed is disposed between the first edge and the printhead body, and is in fluid communication with an ink reservoir. At least one chamber is in fluid communication with the edge feed and a plate is provided with a plurality of apertures, each aperture being capable of cooperating with at least one of the at least one chambers to allow ink to be ejected from the at least one of the at least one chambers.

28 Claims, 17 Drawing Sheets

PERFORMANCE INKJET PRINTHEAD CHIP LAYOUTS AND ASSEMBLIES

TECHNICAL FIELD

The present invention relates to inkjet printhead chip layouts and, more specifically, to ink jet printhead chips having an asymmetric layout wherein the heaters and TAB bond pads are located on opposing edges, and to inkjet printhead assemblies.

BACKGROUND OF THE INVENTION

Ink jet printers typically include recording heads, referred to hereinafter as printheads, that employ transducers which utilize kinetic energy to eject ink droplets. For example, thermal printheads rapidly heat thin film resistors (or heaters) to boil ink, thereby ejecting an ink droplet onto a print receiving medium, such as paper. According to this ink jet method, upon firing a resistor, a current is passed through the resistor to rapidly generate heat. The heat generated by the resistor rapidly boils or nucleates a layer of ink in contact with or in proximity to a surface of the resistor.

The nucleation causes a rapid vaporization of the ink vehicle, creating a vapor bubble in the layer of ink. The expanding vapor bubble pushes a portion of the remaining ink through an aperture or orifice in a plate, so as to deposit one or more drops of the ink on a print receiving medium, such as a sheet of paper. The properly sequenced ejection of ink from each orifice causes characters or other images to be printed upon the print receiving medium as the printhead is moved relative to the print receiving medium.

Typically, the orifices provided on such a plate are arranged in a pair of linear arrays. Moreover, the paper is typically shifted each time the printhead moves across the paper. The thermal ink jet printer is generally fast and quiet, as only the ink droplet is in contact with the paper. Such printers produce high quality printing and can be made both compact and economical.

There are many performance issues that should be considered when designing inkjet printers. Many of these issues are tied to the inkjet technology and, more specifically, to the design of the chips used in the printheads. In many regards, the printhead chip architecture and design dictates the overall performance of the printer.

Overall, however, the performance goals of printhead chip design must also be balanced with meeting cost and manufacturability requirements. For example, the cost of processed silicon is a first order function of chip area. Therefore, in order to minimize cost, the area of any chips used in the printhead should be minimized.

Conventional printhead chip architectures, such as those shown in FIGS. 1A and 1B, target specific design requirements, but have certain limitations. For example, center via ink feed chips 111 might ease printhead assembly, but the center via 116 takes up valuable area on the chip and makes the chip prone to cracking. Moreover, additional area on the chip is also required to wire the control and drive signals of the chip around the via 116, as represented by chip wiring 121.

Edge ink feed designs (commonly referred to as "edgefeeds"), such as those utilized by the chip 211 shown in FIG. 1B, have arisen as an alternative to center via ink feed designs. Edgefeeds do not have a via, but rather have heaters 224 on opposing edges of the chip 211, with interconnects 270 on opposing ends of the chip. Accordingly, as there is no center via, less area on the chip is wasted, and the chips 211 are not as prone to cracking.

Typically, interconnects 270 (e.g., TAB bond pads) and their corresponding beams 271 (e.g., beams coming from a TAB circuit) must be protected from the ink, such as by covering them with encapsulant 272 for example. These areas of applied encapsulant 272 generally constitute the points on the printhead 210 that will come the closest to contacting the print receiving medium 232 as it is passed by the printhead. Therefore, as shown in FIG. 2, to avoid smearing any ink applied to the print receiving medium 232, it is desirable to maintain an appropriate gap (G) (commonly referred to in the art as the "paper gap") between the print receiving medium and the printhead 210.

The distance (D) over which the paper gap (G) must be maintained is commonly referred to in the art as the critical paper gap control region. As can be understood, ensuring a proper paper gap (G) becomes more difficult as critical paper gap control regions (D) increase. For example, because the interconnects 270 in conventional edgefeeds are placed at the ends of the chip 211, there is a substantial distance between areas of encapsulant 272. As these areas of encapsulant 272 define a substantial critical paper gap control region (D), controlling the paper gap (G) in printers utilizing conventional edgefeed printhead chips 211 can often be difficult.

Moreover, inkjet printers typically utilize devices, such as an exit roller or star wheel 238, for example, to maintain the paper gap (G). The distance (M) the print receiving medium 232 must travel past the last appropriate nozzle position (N) on the printhead 211 in order to be held at the desired paper gap (G) over the critical paper gap control region (D) (e.g., the distance the print receiving medium must travel to effectively reach a device such as device 238), is commonly referred to in the art as the minimum print margin. The minimum print margin (M) defines, for example, how close to an edge of the print receiving medium 232 the printer can print without potentially experiencing print quality problems. As can be understood from FIG. 2, because of the additional area on the printhead required to bond (and encapsulate) the relevant portions of the connecting circuit (not shown) to the interconnects (not shown) of the chip 211, printers using conventional edgefeed printhead chips typically also suffer from larger minimum print margins (M).

Accordingly, it would be advantageous to have an inkjet printhead chip design that has reduced dimensions. Moreover, it would be advantageous to have an inkjet printhead chip design that could retain the benefits of a conventional edgefeed design, while minimizing the critical paper gap control region (D). Furthermore, it would be desirable to have an inkjet printhead chip design that retains the benefits of conventional edgefeed designs while minimizing the minimum paper margin (M).

SUMMARY OF THE INVENTION

Accordingly, it is an object of the present invention to provide printhead chips that overcome problems associated with conventional chips.

It is another object of the present invention to provide inkjet printhead chips that minimize the critical paper gap control region (D) in the printer in which it is used.

It is a further object of the present invention to provide printhead chips that minimize the minimum paper margin (M) in the printer in which it is used.

Still another object of the present invention is to provide printhead chips that are easy to manufacture and assemble.

Yet a further object of the present invention is to provide inkjet printhead chips that have a minimized chip area.

Still another object of the present invention is to provide printhead chips with improved operational characteristics.

A further object of the present invention is to provide printhead chips that are inexpensive to produce.

According to one embodiment of the present invention, an inkjet printhead chip comprises a substrate, a plurality of transducers, a plurality of interconnects and driver circuitry capable of electrically connecting the transducers and the interconnects. The plurality of transducers are arranged along a first edge of a surface of the substrate. Meanwhile the plurality of interconnects are arranged along an opposing second edge of the surface of the substrate. The driver circuitry is arranged on the substrate.

Preferably, the plurality of transducers are capable of receiving ink along the first edge. In one embodiment of the present invention, the transducers are capable of receiving ink only along this first edge. More preferably, a plurality of transducers are arranged only along the first edge, while the plurality of interconnects are arranged only along the second edge.

In further preferred embodiments, the substrate is substantially integral and the driver circuitry comprises switchable addressing circuitry. For example, the switchable addressing circuitry comprises transistors and/or multiplexing circuitry, and preferably comprises transient addressing circuitry. In addition, the driver circuitry comprises a plurality of conductive leads arranged on the substrate generally perpendicular to the second edge.

Still another preferred embodiment of the present invention separates each of the transducers from adjacent transducers by less than 1/300 of an inch. More preferably, each of the transducers is separated from adjacent transducers by approximately 1/600 of an inch. The transducers can comprise piezoelectric elements, although heater resisters are preferred.

In a preferred embodiment, the plurality of transducers extend along the first edge for a transducer length. Meanwhile the plurality of interconnects extend along the second edge for an interconnect length, wherein the transducer length is at least as long as the interconnect length. In a further preferred embodiment, the transducer length is approximately equal to the interconnect length.

In another embodiment of the present invention, an inkjet printhead assembly comprises a body and a printhead chip assembly arranged on a print surface of the body. The print surface is capable of being arranged generally parallel to a surface of a print-receiving medium. The printhead chip assembly according to this embodiment includes a substrate, an edge feed, at least one chamber, and a plate.

The substrate according to this embodiment has a surface with opposing first and second edges, a plurality of transducers arranged along the first edge and a plurality of interconnects arranged along the second edge. The edge feed is disposed between the first edge and the printhead body and is in fluid communication with an ink reservoir of the body. The at least one chamber is in fluid communication with the edge feed and the plate is provided with a plurality of apertures, each aperture being capable of cooperating with at least one of the at least one chambers to allow ink to be ejected from said chambers.

Preferably, the printhead chip assembly is arranged adjacent to an end of the print surface. More preferably, the substrate surface further comprises opposing ends, one of which being adjacent the end of the print surface. In yet another preferred embodiment of this invention, the printhead chip assembly comprises only one substrate.

In a preferred embodiment, the inkjet printhead is capable of causing ink to be ejected onto the print-receiving medium within a print swath height. In addition, the plurality of interconnects extend along the second edge for an interconnect length, wherein the swath height is at least as long as the interconnect length. More preferably, the interconnect length is less than the swath height.

A further preferred embodiment comprises an encapsulant generally covering the plurality of interconnects and extending along the second edge for an encapsulant length. According to one embodiment, the swath height is at least as long as the encapsulant length. More preferably, the encapsulate length is less than the swath height, In yet another embodiment of the present invention, an inkjet printhead capable of causing ink to be ejected onto a print-receiving medium within a print swath height is provided. The inkjet printhead comprises a body and a printhead chip assembly. The body has an ink reservoir and a print surface capable of being arranged generally parallel to a surface of a print-receiving medium. Meanwhile, the printhead chip assembly is arranged on the print surface adjacent an end of the print surface.

In this embodiment, the printhead chip assembly comprises a single substantially integral substrate, an edge feed, at least one chamber, and a plate. The substrate has a surface with opposing first and second edges, a plurality of the transducers are arranged only along the first edge and a plurality of interconnects are arranged only along the second edge, wherein the plurality of interconnects extending along the second edge extend for an interconnect length that is less than the swath height. In addition, the edge feed is disposed between the first edge and the printhead body, and is in fluid communication with the ink reservoir. The at least one chamber is in fluid communication with the edge feed. In addition, the plate is provided with a plurality of apertures, each aperture being capable of cooperating with at least one of the at least one chambers to allow ink to be ejected from said chambers.

Still other aspects of the present invention will become apparent to those skilled in this art from the following description wherein there is shown and described various embodiments of this invention, simply by way of illustration. As will be realized, the invention is capable of other different aspects and embodiments without departing from the scope of the invention. Accordingly, the drawings and descriptions should be regarded as illustrative in nature and not as restrictive in nature.

BRIEF DESCRIPTION OF THE DRAWINGS

While the specification concludes with claims particularly pointing out and distinctly claiming the invention, it is believed the same will be better understood from the following description taken in connection with the accompanying drawings in which:

DETAILED DESCRIPTION OF THE PREFERRED EMBODIMENTS

Figure 1B:
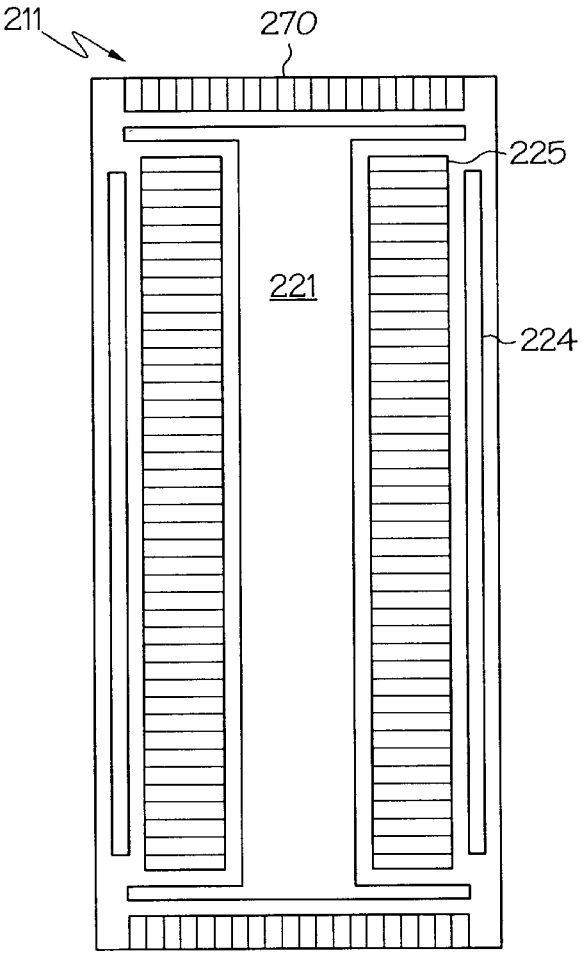
FIG. 1B (PRIOR ART)
FIGS. 1A and 1B are top schematic views of conventional printhead chips.
Figure 1A:
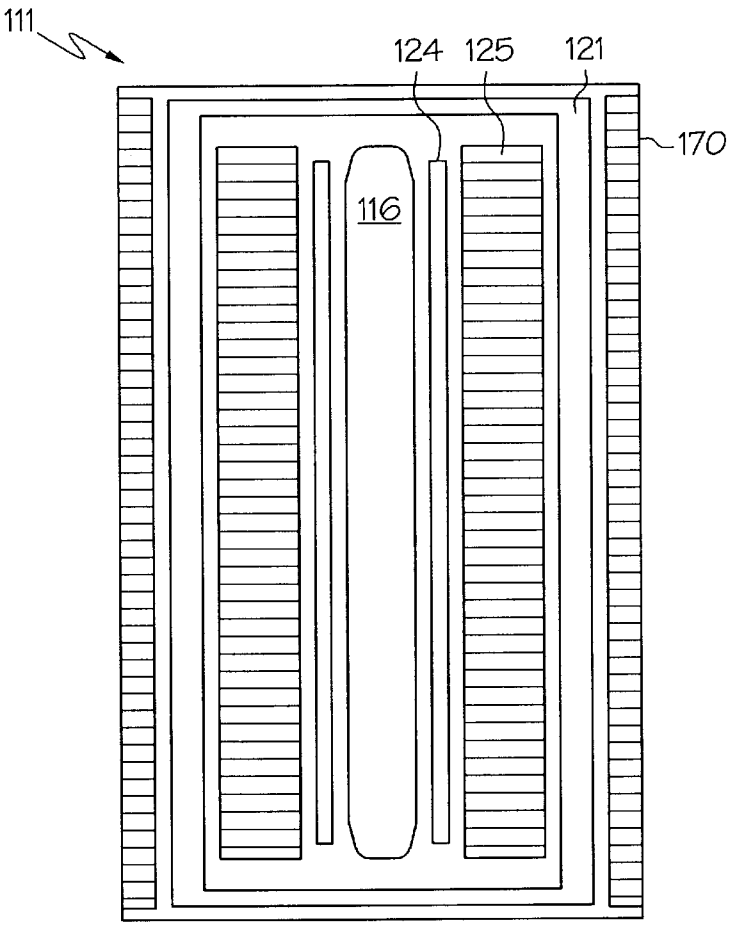
FIG. 1A (PRIOR ART)
Figure 2:
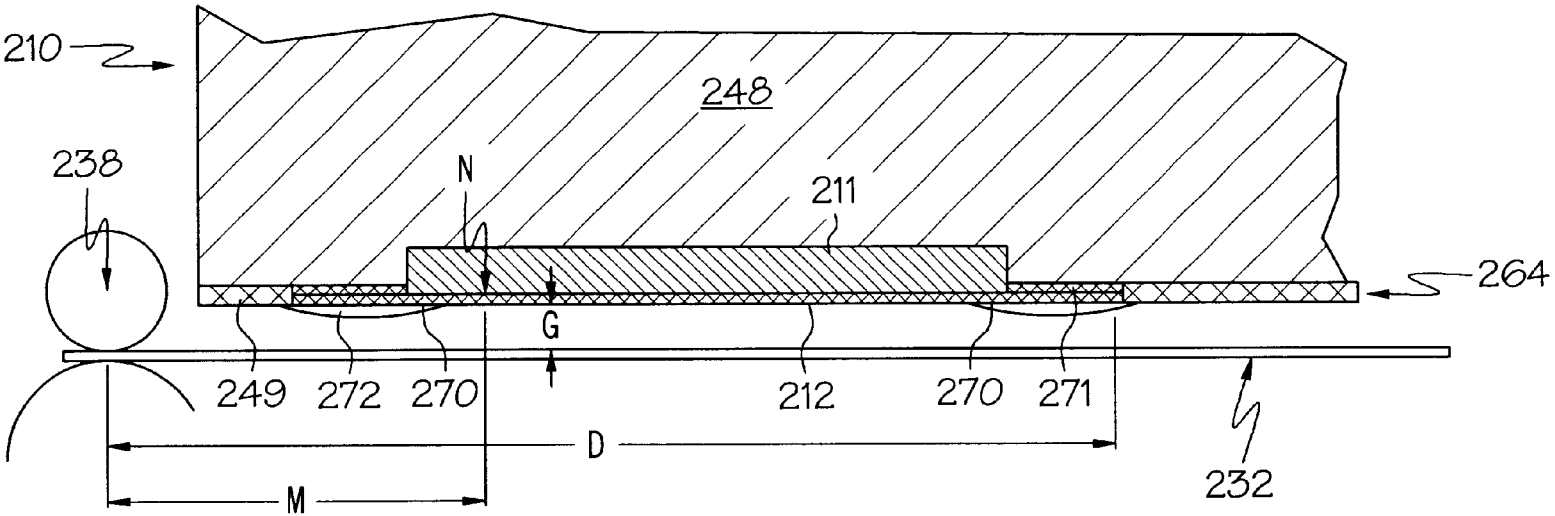
FIG. 2 (PRIOR ART)
FIG. 2 is a partial cross-sectional view of a conventional inkjet printer detailing the printhead and a print receiving medium being passed therethrough.
Figure 3:
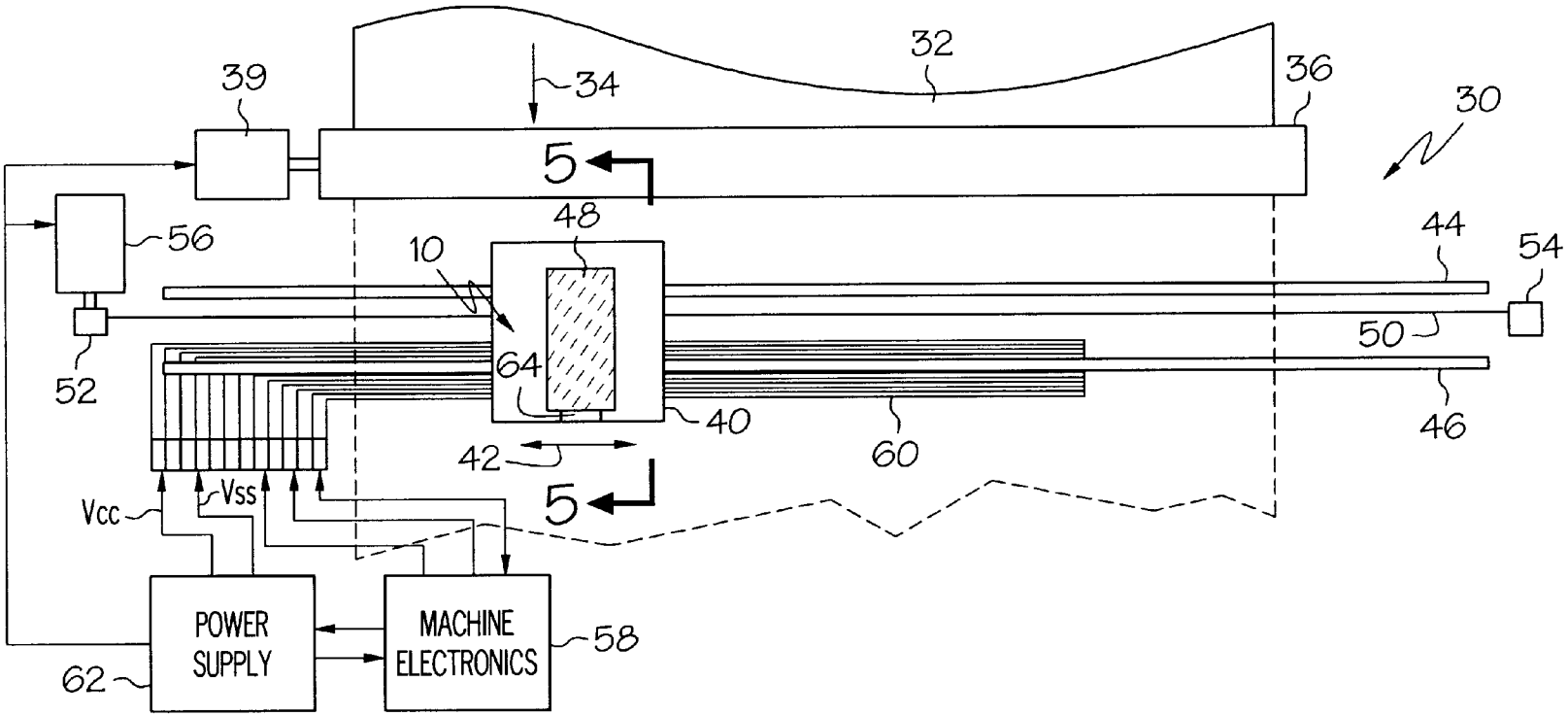
FIG. 3 is a schematic plan view of a thermal ink jet printer for receiving a printhead to which the novel apparatus of the present invention pertains.

Referring now to the drawings in detail, wherein like numerals indicate the same elements throughout the views, FIG. 3 illustrates an embodiment of an ink jet printer 30 to which the present invention can be applicable. A print receiving medium 32, which can be a recording medium made from paper, thin film plastic or the like, can be moved in the direction of an arrow 34, under the control of a medium drive mechanism, such as a drive motor 39, for example.

Figure 4:
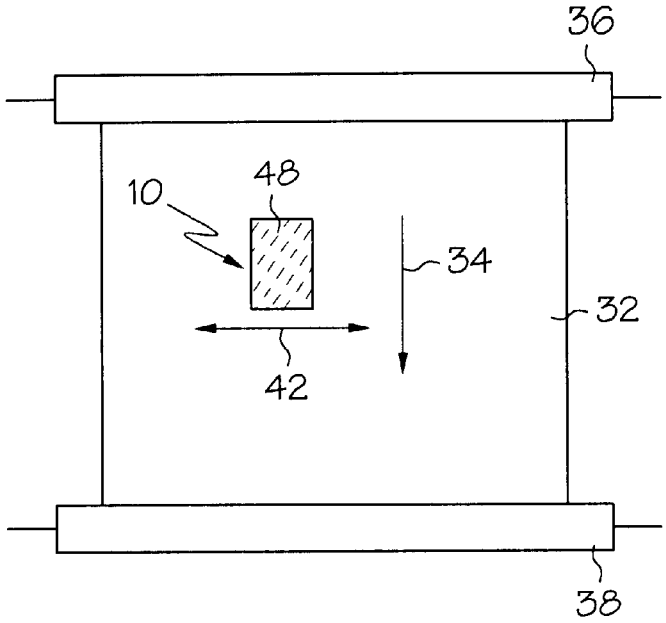
FIG. 4 is a schematic and fragmentary view of a portion of the apparatus illustrated in FIG. 3, showing printhead and print receiving medium relative motion.

As shown in FIGS. 3 and 4, printheads 10 can be mounted on a carrier 40, which can be carried in close proximity to a print receiving medium 32, which in turn can be transported by, for example, rollers, such as roller 36, and/or star wheels, such as star wheel 38. As shown by the arrow 42, the printhead 10 (and thus the printhead carrier 40) can be mounted for orthogonal, reciprocatory motion relative to the print receiving media 32. To this end, and as shown in FIG. 3, the carrier 40 can be mounted for reciprocation along a pair of guide shafts 44 and 46.

The reciprocatory or side-to-side motion of the carrier 40 can be established by a carrier drive, such as one having a transmission mechanism including a cable or drive belt 50 and pulleys 52, 54 which carry the belt 50 driven by a motor 56. In this manner, the printhead 10 may be moved and positioned at designated positions along a path defined by and under the control of the carrier drive and machine electronics 58. The carrier 40 and the printhead 10 are connected electrically by a flexible printed circuit cable 60 for supplying power from the power supply 62 to printhead 10, and to supply control and data signals to printhead 10 from the machine electronics 58, which includes the printer control logic (PCL).

Figure 5A:
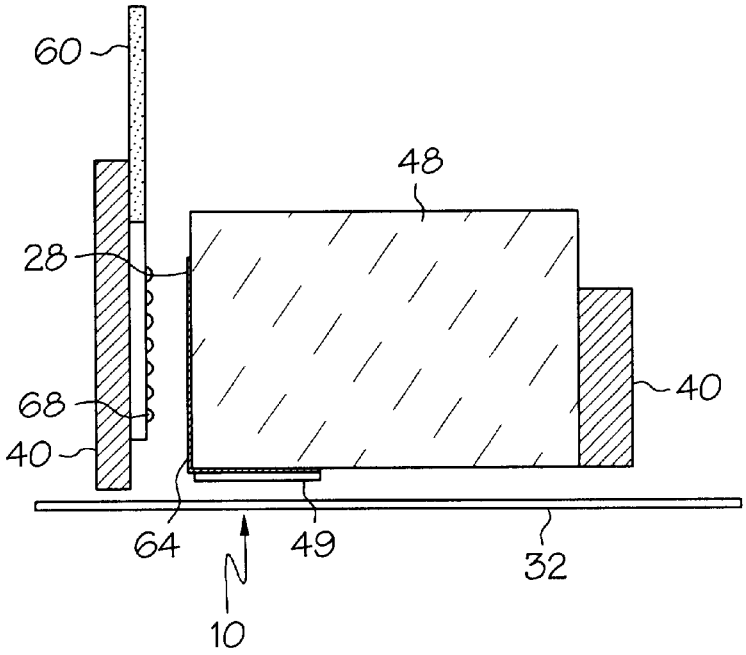
FIG. 5A is an enlarged, partially exploded, fragmentary cross-sectional view of a portion of the apparatus shown in FIG. 3, taken along line 5—5 of FIG. 3.
Figure 5B:
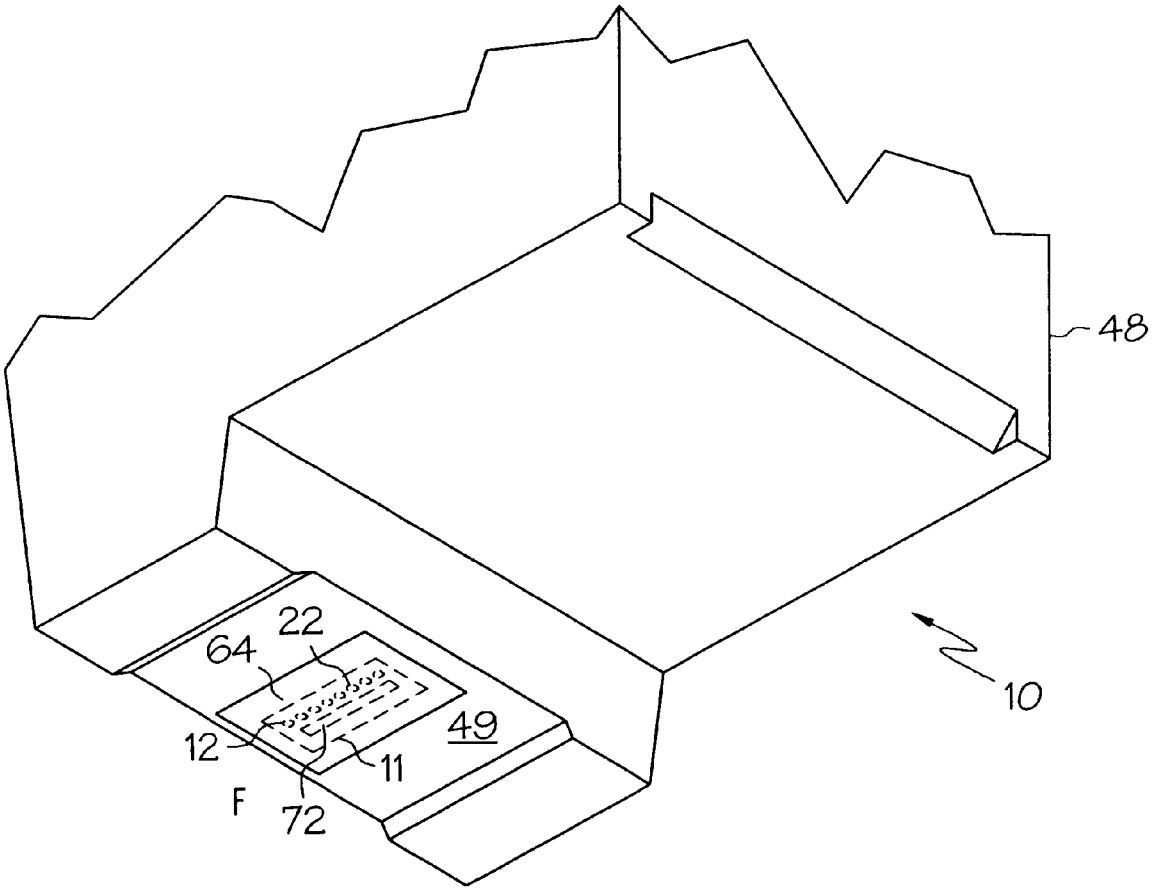
FIG. 5B is a partial perspective view of an ink jet printhead according to one embodiment of the present invention.

Referring now to FIGS. 5A–5B, according to one embodiment of the present invention, printheads 10 include printhead chips 11 attached, preferably by way of an adhesive bond, to a plate 12 having a plurality of individually selectable and actuable nozzle orifices or apertures 22. The printhead 10 can also include a supply of ink in, for example, an ink-holding reservoir 48, such as a tank or bottle. Preferably, the nozzle plate 12 and chip 11 are bonded to a print surface 49 on the printhead 10. The print surface 49 is capable of being arranged generally parallel to a surface of a print receiving medium 32. In one embodiment, the print surface 49 extends from the ink reservoir 48 wherein the combination comprises an inkjet cartridge assembly.

Figure 6:
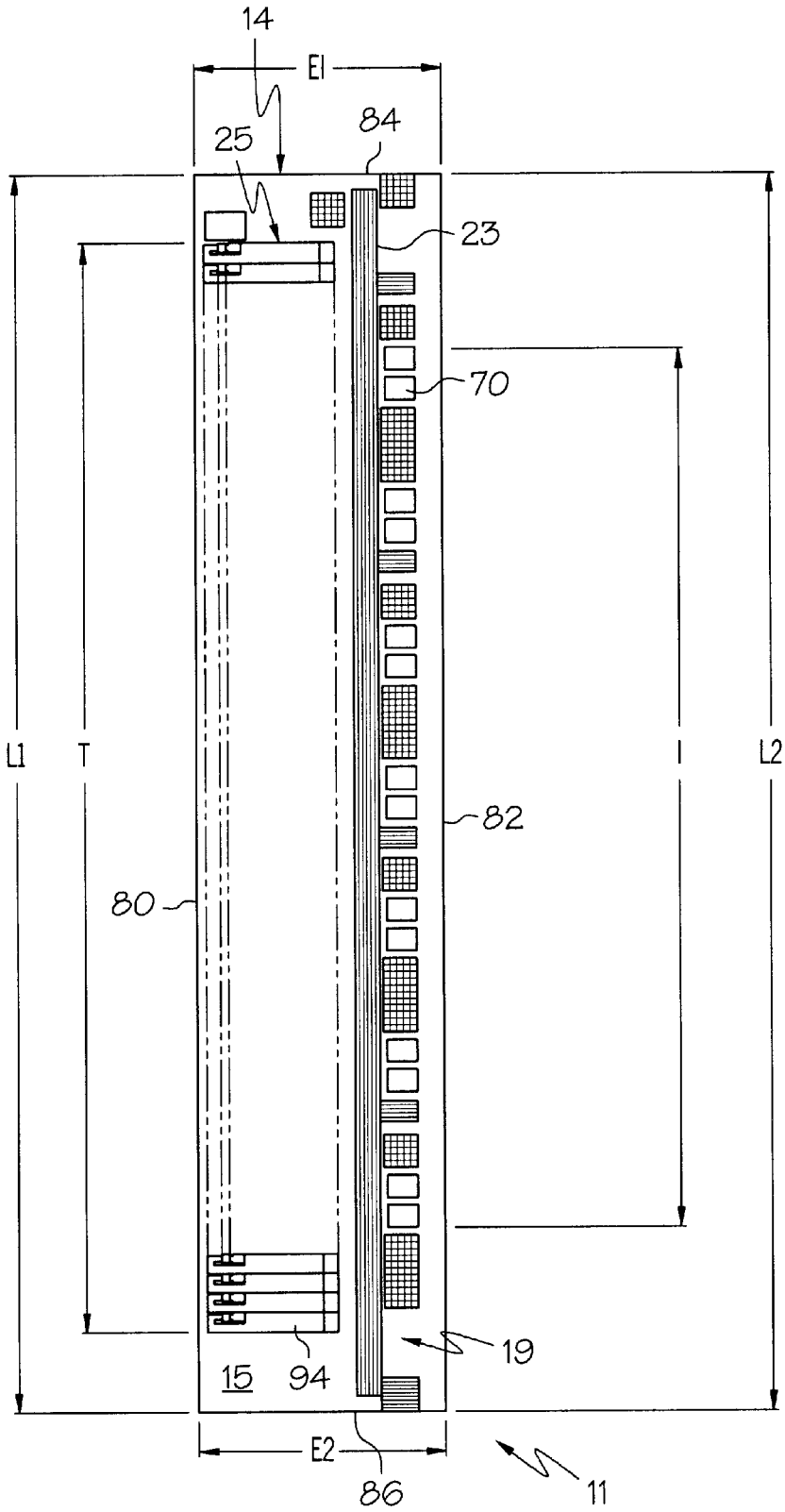
FIG. 6 is a top view of the inkjet printhead chip shown by cross-section in FIG. 5B.
Figure 6A:
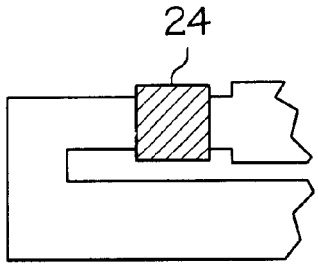
FIG. 6A is an enlarged top view of a portion of the chip shown in FIG. 6.

As shown in FIG. 6, chips 11 include a substrate 14 having a surface 15 with a first edge 80 and a second edge 82. Preferably, the chip 11 only includes one such substrate 14 and, furthermore, the substrate is preferably integral. The substrate 14 can be formed of a variety of materials, including glass and quartz. However, a substrate 14 comprising P-Type silicon is preferred.

The surface 15 of the substrate 14 is preferably generally rectangular in shape, although it could take on a number of other shapes, such as any other polygonal shape. Moreover, the surface 15 of the substrate 14 can also have opposing ends 84, 86. In a preferred embodiment of the present invention, the opposing ends 84, 86 are each of a length (E1, E2) which are less than the length (L1, L2) of each of the edges 80, 82. In addition, the dimensions E1, E2, L1, and L2 should be minimized in order to reduce the area of the chip 11.

A plurality of energy-generating elements or transducers 24 are arranged along the first edge 80 of the substrate 14. According to a preferred embodiment of the present invention, the transducers 24 are arranged in a single array which extends generally parallel and in close proximity to the first edge 80 for a transducer length (T), which is preferably approximately equal to the length L1. In one embodiment, the transducers 24 can receive ink along the first edge 80. Preferably, the plurality of transducers 24 are arranged and are capable of receiving ink only along the first edge 80, as utilized with edge-feed chip arrangements.

The transducers 24 preferably comprise electro-thermal converting elements (e.g., heaters), although a variety of different elements can be utilized, such as electromechanical converting elements (e.g., piezoelectric elements), for example. In a preferred form, the transducers 24 comprise heaters formed on the chip 11. The heaters 24, such as thin film resistors for example, can generate thermal energy by applying a voltage difference across electrodes (not shown) connected to resistive material forming the resistor.

Figure 7:
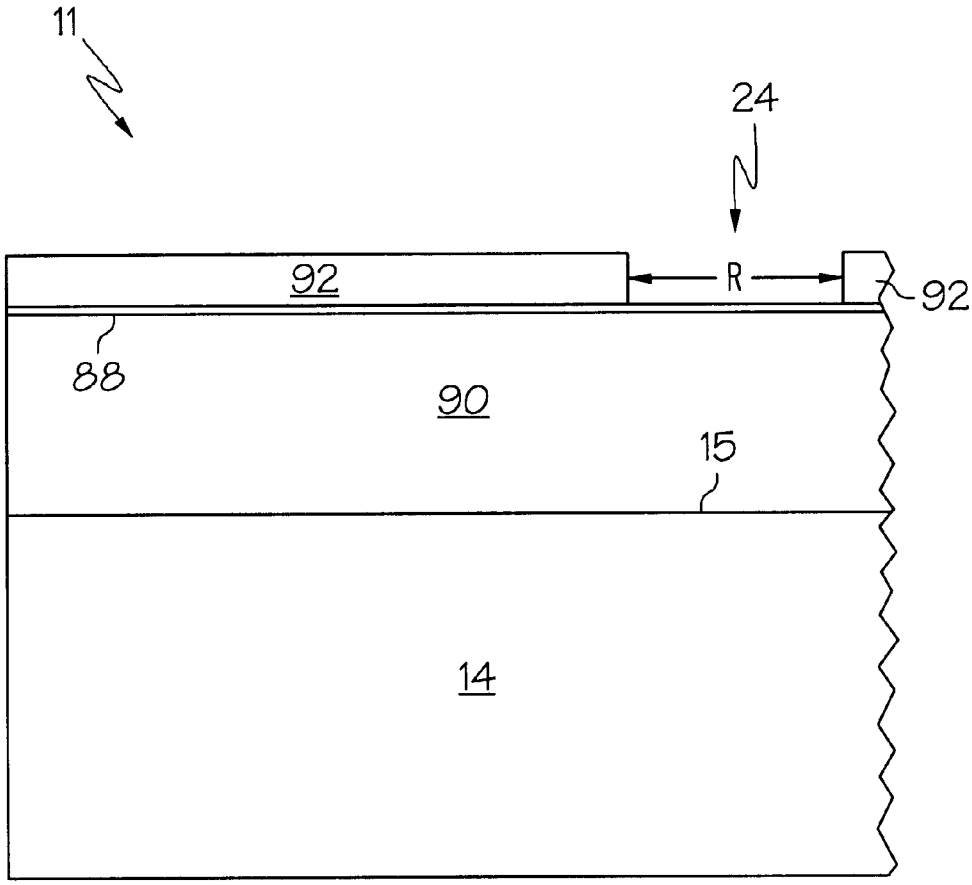
FIG. 7 is a partial cross-sectional detail of a printhead chip.

Referring now to FIG. 7, according to a preferred embodiment of the present invention, the thin film resistors 24 can be formed from a resistive layer 88 that is deposited on the substrate base 14. Although the resistive layer 88 can comprise materials such as tantalum aluminum (TaAl), it preferably comprises hafnium diboride ($HfB_2$). According to one embodiment of the present invention, a thermal barrier 90 is preferably formed between the surface 15 of the substrate 14 and the resistive layer 88. Although the thermal barrier 90 can comprise a variety of materials, a thermal boundary layer formed from a combination of a silicon dioxide ($SiO_2$) layer and a boron-phosphorous doped silicate glass (BPSG) layer is preferred.

A conductive layer 92 can be formed over or under the resistive layer 88. Preferably, the conductive layer 92 is deposited over the resistive layer 88. This conductive layer 92 could comprise a variety of different materials, but preferably a comprises aluminum-copper alloy (AlCu).

To form the resistors 24, portions of the respective upper layer can be removed by techniques known in the art, such as chemical etching. Alternatively, the upper layer can be applied only to selected locations by sputtering the layer onto the substrate 14, or by using similar technologies. With the selected portions of the resistive layer 88 exposed, the remaining portions of the conductive layer 92 form electrodes for the now-formed thin film resistors 24.

To drive one of the resistors 24, a voltage potential is applied between appropriate portions of the conductive layer 92. A current will conduct through the conductive layer 92, but will not appreciably conduct through the resistive layer 88, except at the selected region (R), representing the location of resistor 24, where it has no other electrical path except through the resistive layer. At the region (R) of the resistive layer 88, the electric current in the resistive layer causes heating which nucleates and prints a drop of ink.

Referring back to FIG. 6, a plurality of interconnects 70 are arranged along the second edge 82 of the substrate 14. The interconnects 70 are used to transmit input and/or output signals to the chip 11 from other locations, such as the machine electronics 58. While a variety of different interconnects 70 can be used with the present invention, interconnects such as those utilized to connect with beams 71 from a tape automated bonding (TAB) circuit 64 are preferred.

Although a variety of conductive materials, such as gold-plated aluminum, for example, can be used to form the interconnects 70, the interconnects are preferably formed from AlCu. According to a preferred embodiment of the present invention, the interconnects 70 are also arranged in a single array which extends generally parallel and in close proximity to the second edge 82 for an interconnect length (I), which is preferably approximately equal to the length L2. Preferably, the interconnects 70 are also arranged only along the second edge 82.

The chip 11 also includes driver circuitry 25 arranged on the substrate 14. The driver circuitry 25 is capable of electrically connecting the transducers 24 and the interconnects 70, and allows the transducers to be selectively driven according to input signals received at the interconnects. The driver circuitry 25 preferably comprises addressing circuitry capable of switching the transducers 24 on and off. For example, the driver circuitry 25 can comprise active elements 94 arranged on the substrate 14, but could also comprise other elements, such as one or more integrated circuits, for example.

In an embodiment of the present invention in which active elements 94 comprise the driver circuitry 25, the active elements are preferably arranged on the surface 15 of the substrate 14 in an array which is generally parallel to at least one of the edges 80,82. These active elements 94 can comprise semiconductor devices capable of being formed in silicon, such as is known by those of ordinary skill in this art. For example, transistors 94, such as field effect transistors (FETs) for example, can be formed on the substrate 14 and electrically connected to the transducers 24. The driver circuitry 25 can also include a plurality of conductive leads 19, such as address lines 23 and power bus lines 21, for example, connecting the active devices 94 and transducers 24 to the interconnects 70.

According to this embodiment of the present invention, the transistors 94 function as on-off switches for the transducers 24. Under computer or applications specific integrated circuits control (ASIC), a fire pulse is applied to one or more of the transistors 94, allowing currents to control the respective transducers 24 to which the transistors are connected. More preferably, a multiplexing scheme can be implemented with the driver circuitry 25, as can be understood by one of ordinary skill in the art.

Figure 8:
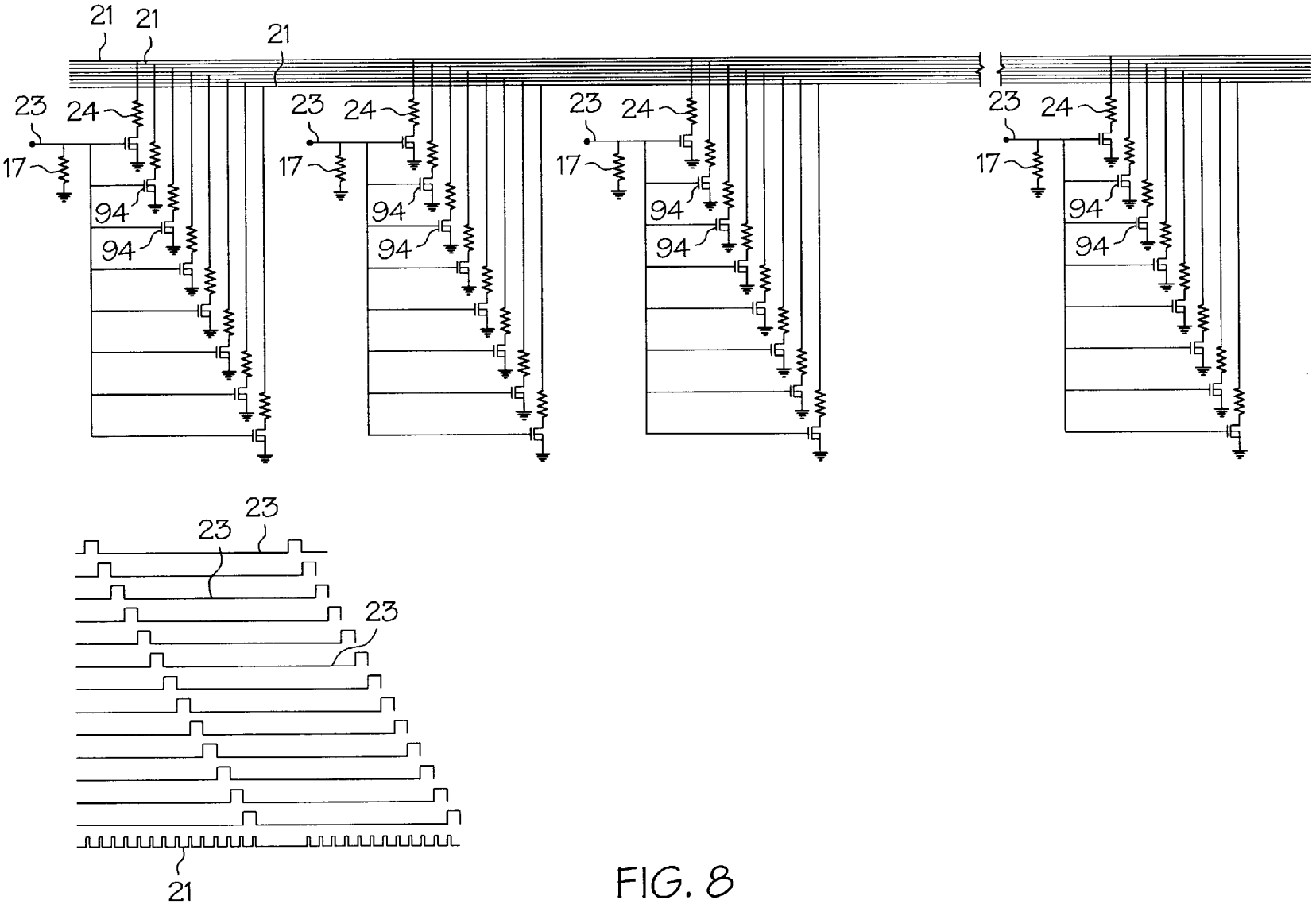
FIG. 8 is a schematic view of a multiplexing scheme for use with inkjet printheads.

A multiplexing scheme according to a preferred embodiment of this invention can be described with the aid of FIG. 8. In the figure, only the current flow path on the chip 11 is shown. The circuit on the chip 11 comprises transducers 24, power bus lines 21, address lines 23 and metal oxide semiconductor field effect transistors (MOSFET's) 94.

In a preferred embodiment, the gates of the MOSFETs 94 are connected to the address lines 23. The source side of the MOSFETs 94 are connected to a ground plane. Meanwhile, the drain side of each MOSFET 94 is connected to a respective one of the transducers 24. Each of the transducers 24 is also connected to a power bus line 21. In this example, the address lines 23 are utilized to connect certain ones of the interconnects 70 to the gates of channel MOSFETs 94, while the power bus lines 21 are utilized to connect certain ones of the interconnects to the transducers 24. The leads 19 are preferably located on the surface 15 of the substrate 14, just inside of the interconnects 70, as generally shown in FIG. 6.

Figure 9:
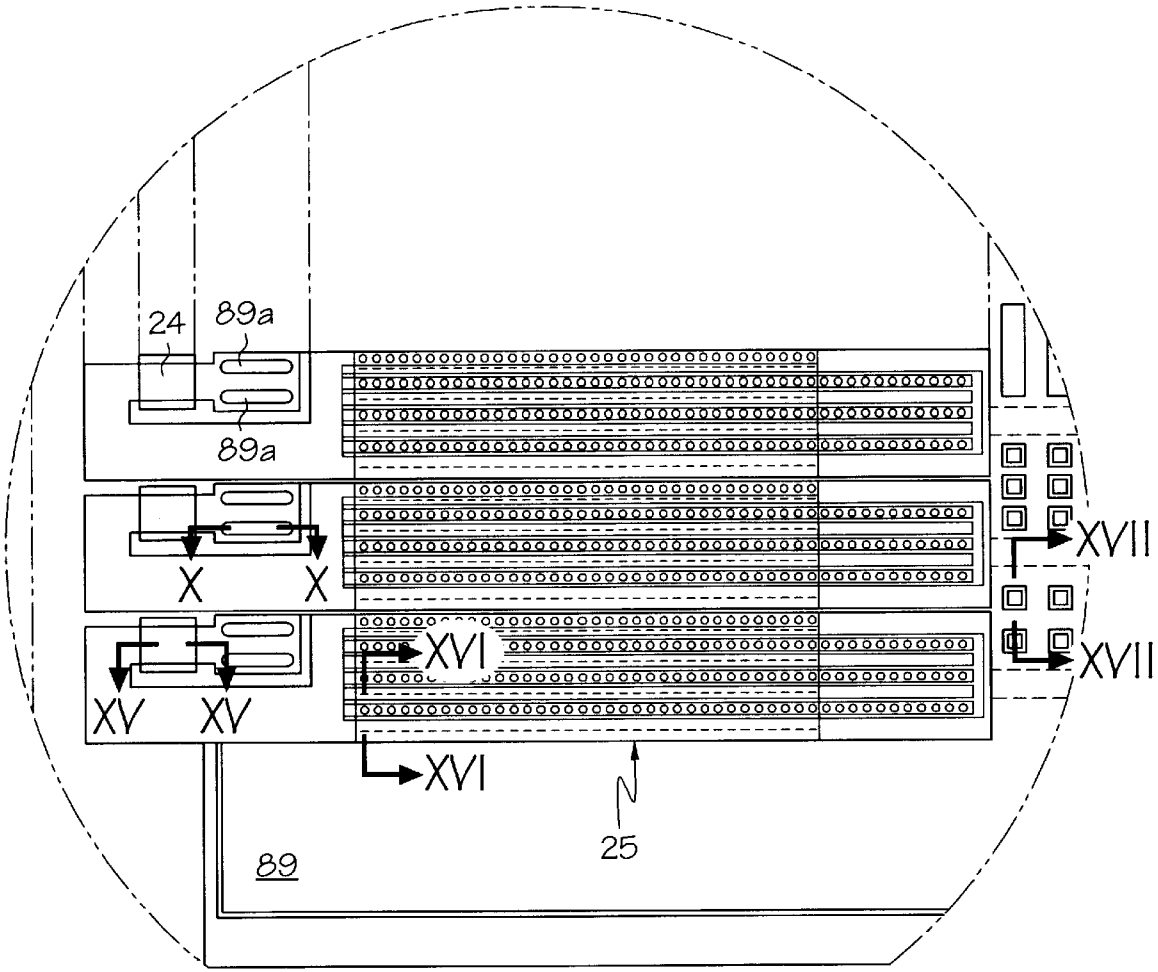
FIG. 9 is an enlarged top view of a portion of the chip shown in FIG. 6.
Figure 17:
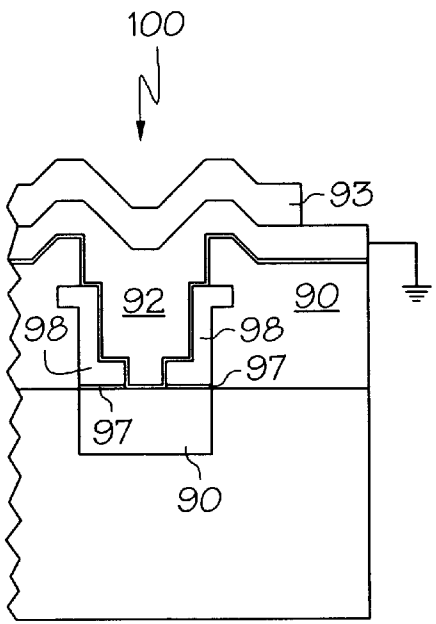
FIG. 17 is an enlarged, partially exploded, fragmentary cross-sectional view of a portion of the apparatus shown in FIG. 9, taken along line XVII—XVII of FIG. 9.
Figure 16:
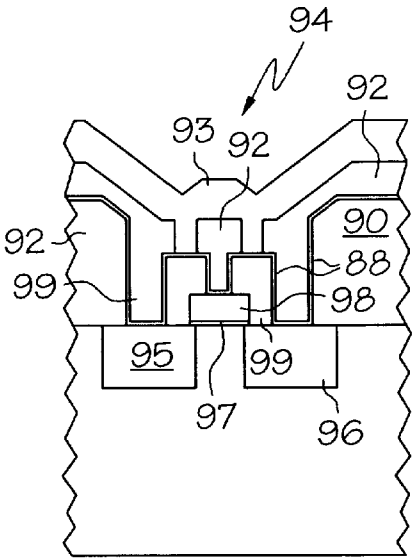
FIG. 16 is an enlarged, partially exploded, fragmentary cross-sectional view of a portion of the apparatus shown in FIG. 9, taken along line XVI—XVI of FIG. 9.
Figure 15:
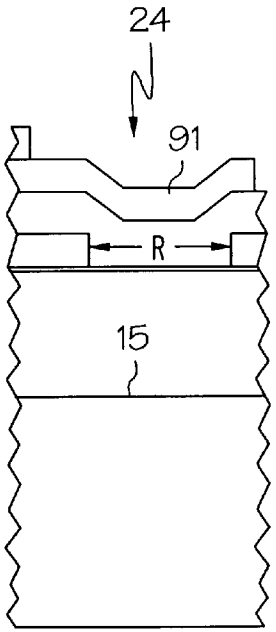
FIG. 15 is an enlarged, partially exploded, fragmentary cross-sectional view of a portion of the apparatus shown in FIG. 9, taken along line XV—XV of FIG. 9.
Figure 10:
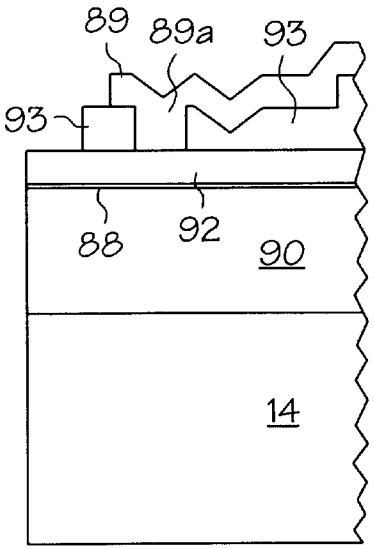
FIG. 10 is an enlarged, partially exploded, fragmentary cross-sectional view of a portion of the apparatus shown in FIG. 9, taken along line X—X of FIG. 9.

FIG. 9 shows by section lines X—X, XV—XV, XVI—XVI and XVII—XVII the cross-sectional views illustrated in FIG. 10 (X—X); FIG. 15 (XV—XV); FIG. 16 (XVI—XVI); and FIG. 17 (XVII—XVII). Preferably, MOSFET 94 has an N+ doped drain 95 and N+ doped source 96, having an oxide gate layer 97 between substrate 14 and a conductive polysilicon region 98 which forms the gate contact. Above the polysilicon 98 is a field region 99 of BPSG.

The subcontact 100 is located at the ground bus connection of the channel MOSFET 94. Subcontact 100 is an essentially standard element contacting each MOSFET source 96 to the silicon substrate 14. As shown in FIG. 10, subcontact 100 has an N+ doped region and a large area of polysilicon conductor 98 with an oxide gate layer 97.

To cause a current flow in one of the transducers 24, an address line 23 connected to the transducer is brought to a voltage potential sufficient to enable the MOSFET 94 connected to the transducer. This voltage is typically above the threshold voltage of MOSFET 94, but below the gate breakdown voltage of MOSFET. However, no current flows to the transducer 24 until the power bus line 21 is switched on.

While the MOSFET 94 is in the enabled state, a voltage potential is applied to the power bus line 21. During the period when both the gate voltage and the power bus voltage are held high, current will flow to the transducer 24. Preferably, each address line 23 connects to a group of transistors 94, and each transistor in the group is connected to only one of the power bus lines 21 through a transducer 24.

Clock control signals for both the address lines 23 and the power control lines 21 are preferably generated in the printer (not shown). The power bus lines 21 are switched on and off by drive transistors (not shown) in the printer, one for each power bus line, under control by an ASIC in the printer. The gates of the MOSFETs 94 are enabled every clock cycle, but the power bus lines 21 are only turned on in response to a print command, i.e. to "fire" a particular transducer 24. The timing of this control is shown in the lower left of FIG. 8. The other component shown in FIG. 8 is a pulldown resistor 17 connected to each address line 23. The purpose of this component is to ensure the gates of the MOSFETs 94 are at a known potential (ground) when there is no clock signal present.

In yet a further preferred embodiment of the present invention, the chip 11 utilizes the transient addressing method disclosed in pending application Ser. No. 09/368, 666, filed on Aug. 5, 1999, the disclosure of which is hereby incorporated by reference. Utilizing this transient addressing method allows the chip 11 to utilize a single array of transducers 24 (and nozzles 22), while retaining the resolution previously believed to be attainable only by chips with multiple arrays of transducers. According to a preferred embodiment utilizing this method, the single array of transducers 24 is comprised of two columns of transducers (an odd column and an even column).

Moreover, the conductive leads 19 are preferably configured to keep the chip 11 as small as possible. For example, the leads 19 can be arranged on the substrate 14 generally perpendicular to the second edge 82. When viewed in accordance with FIG. 9, this gives the leads 19 a generally horizontal configuration.

Referring back to FIG. 10, in a preferred embodiment of the present invention, a protective layer 93 is deposited over the conductive layer 92. The protective layer 93 preferably comprises a silicon nitride protective layer, and a silicon carbide protective layer deposited over the silicon nitride protective layer. Furthermore, in FIG. 15, immediately at each of the transducers 24, a stress buffer 91, such as a layer of tantalum, is deposited. A stress buffer 91 is advantageous as it absorbs impacts from bubble collapses at the transducers 24.

Finally, an outer conductive layer 89 can be deposited at selected locations. For example, the outer conductive layer 89 could be deposited and passed through vias 89*a* in the protective layer 93 to connect with the conductive layer 92. This outer conductive layer 89 can be used to form the conductive leads 19. Preferably, the outer conductive layer 89 also comprises AlCu.

Chip 11 can be one of many cut from, in a conventional manner, a silicon wafer which, for example, has been coated with photoresist, photolithographically exposed through a mask, subjected to an etch bath and doped by processes well known in the art of semiconductor manufacturing. This process can be repeated through the several layers, including metalization for interconnects 70. Usually, multiple integrated circuit chips 11 are made on a single wafer, which is then cut or diced into individual chips or dies.

Figure 11:
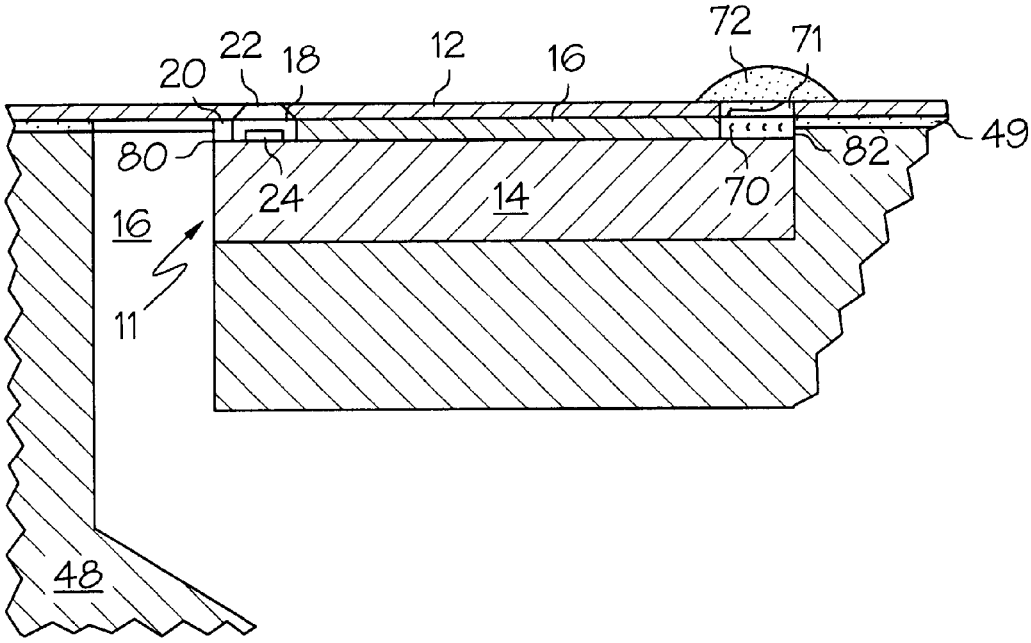
FIG. 11 is an enlarged cross-sectional detail of an ink jet printhead according to one embodiment of the present invention.

Referring to FIG. 11, a printhead 10 according to a preferred embodiment of the present invention has an ink supply labyrinth comprising, for example, an ink vaporization chamber 18. The ink supply labyrinth can be formed between the chip 11 and the plate 12, and can also comprise the edgefeed 16 and conduit laterals 20 for connecting the edgefeed 16 and the chambers 18. The edgefeed 16 allows ink to pass from the ink reservoir 48 (typically behind the chip) into the conduit laterals 20 and into the chambers 18. According to a preferred form of the present invention, the edgefeed 16 exists between the first edge 80 of the chip 11 and the ink reservoir 48.

Figure 12:
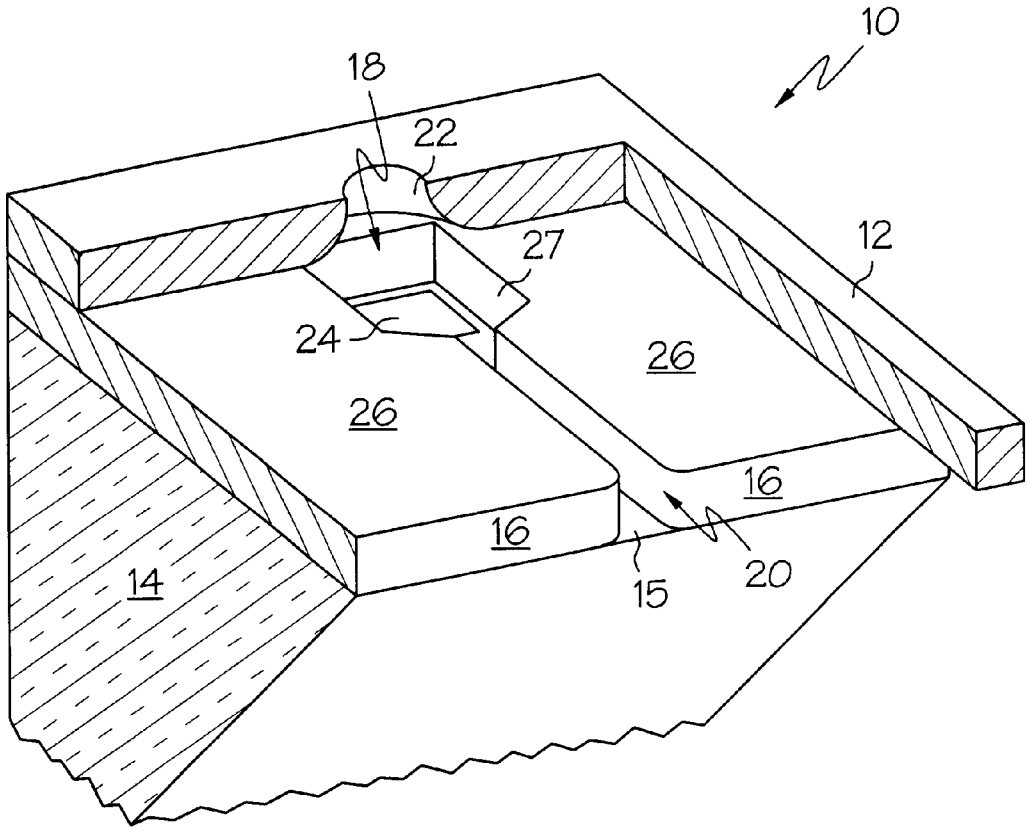
FIG. 12 is a selectively sectioned perspective view of the ink jet printhead of FIG. 11.

As illustrated in FIG. 12, at least a portion of a transducer 24 is arranged within the chamber 18. The chamber 18 has a wall or barrier 27 defining a part of the ink labyrinth. The chamber 18 can be formed, for example, in a thick spacer or insulating film 26, referred to hereinafter as the thick film layer, or in the nozzle plate 12 itself.

The thick film layer 26 can comprise, for example, photosensitive epoxy, and preferably comprises photosensitive acrylate. Typically, the thick film layer 26 is deposited over the resistance layer 88 (as well as any other protective layers 91,93 and/or conductive layers 89, 92) on the printhead chip 11. Thus, the chamber 18 may be formed, for example, by chemically etching away at least a portion of the thick film layer 26, as is also known in the art. Although a plurality of transducers 24 can be arranged within one chamber 18, and portions of an individual transducer can be arranged within a plurality of chambers, each of the transducers is preferably arranged in a respective one of a plurality of chambers. One advantage of arranging each transducer 24 in a respective chamber 18 is that this tends to reduce "cross talk" between the transducers, as can be understood by one of ordinary skill in the art.

A plate 12 provided with at least one aperture 22, cooperates with the at least one chamber 18 to allow the transducers 24 to eject ink from the chamber through the aperture 22. Although the plate 12 can, for example, be integral with the reservoir 48, it is preferably separable to allow for the attachment of a chip 11. As shown in FIG. 11, the plate 12 is preferably formed from a TAB circuit 64 or the like, although it could be separate from the TAB circuit.

The aperture 22, also referred to as an ink ejection orifice or nozzle, in the plate 12 of the printhead 10 confronts the print receiving media 32. Accordingly, ink may be ejected by applying kinetic energy to the ink in the chamber 18 to effect printing on the print receiving media 32. In operation, the ink can flow from the edgefeed 16, into the channel 20, into the chamber 18, and out through the nozzle 22. It should be noted that the nozzles 22 shown in the figures are not to scale, and while a plurality are shown, the number is only by way of example.

The plate 12 (referred to hereinafter as the nozzle plate) can also be made of stainless steel (sometimes coated on opposite sides with gold and/or tantalum for attachment to the thick film 26) or a hard, thin and high wear-resistant polymer layer. Alternatively, the chamber 18 and nozzle 22 can be created from, for example, a single polymer material, as is known in the art. Such a polymer nozzle plate 12 might include, for example, slots or openings to expose interconnects 70.

Depending upon the physical orientation of the nozzle plate 12 relative to the print receiving medium 32, the vertical height or extent of the nozzles 22, the diameter of the nozzles, the angularity of the nozzles, and the spacings between the nozzles determine the vertical size or height (H) of the print swath, and the horizontal width and spacing determine the packing density and firing rate of the printhead 10. As printing speeds and resolution density increase, larger and larger arrays of elements are required. According to one embodiment of the present invention, each of the transducers 24 is separated from an adjacent transducer by less than 1/300th of an inch and, more preferably, by approximately 1/600th of an inch. As can be understood by one of ordinary skill in the art, this separation is utilized to afford the printhead 10 an operational printing resolution of 600 dots per inch (DPI).

Figure 13:
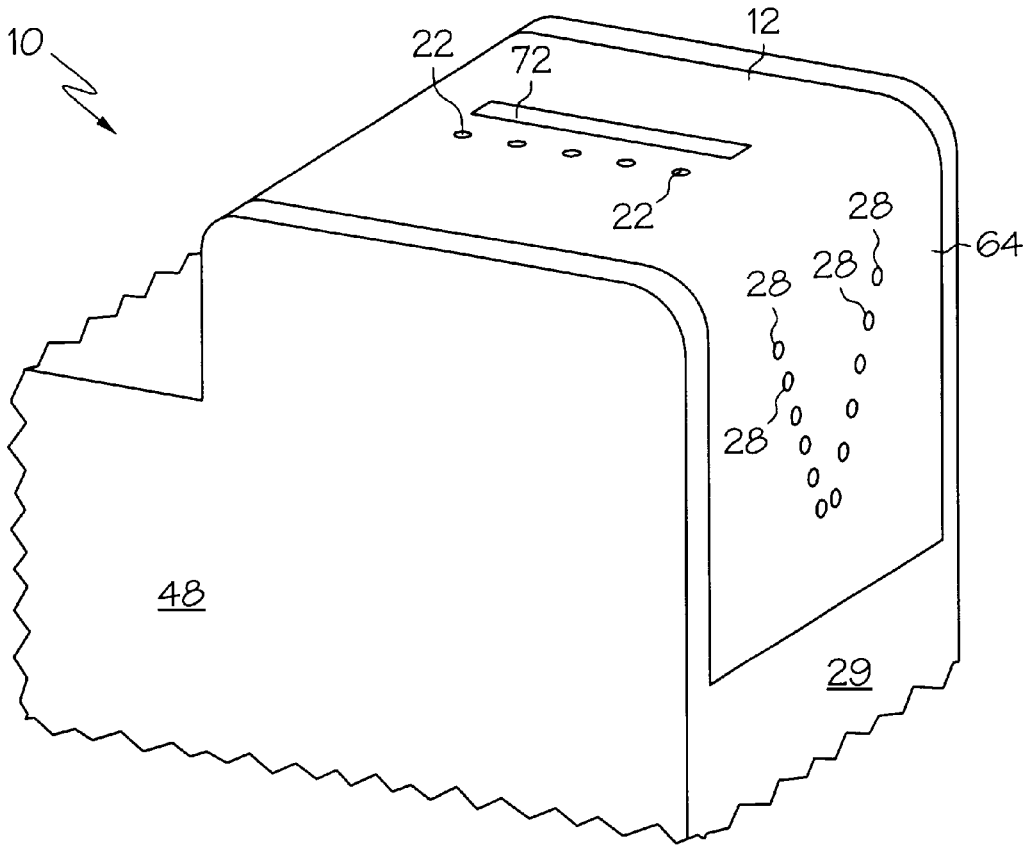
FIG. 13 is a partial perspective view of another inkjet printhead according to the present invention.

As generally shown in FIG. 13, the input and/or output of the chip 11, including control signals and power, can be applied through, for example, a TAB circuit 64 and spaced apart integrated beams or lands 71 therein for making input and output (including electrical) connection to the chip, at interconnects 70. The TAB circuit 64 typically surrounds the chip 11 and can be fastened, for example, to the print surface 49 on the printhead 10 using a pressure sensitive adhesive, also known as a pre-form adhesive. After the printhead chip 11 is arranged on the print surface 49 and the TAB circuit 64 is attached to the interconnects 70, an ultraviolet (UV) photosensitive adhesive can be applied along points on the chip and over the beams 71, as an encapsulant (thereby forming encapsulant areas 72) and protectant. A light source can then be applied to the UV adhesive to cure the same.

The tape 64 can extend along a surface 29 of the reservoir 48, with electrical contact or terminal pads 28 therein for mating engagement with terminal protrusions or projections 68 on the flexible printed circuit cable 60. For ease of illustration and understanding, the portion of the carrier 40 carrying the flexible printed circuit cable 60 and its protruding electrical connections 68 is shown in FIG. 5A as being spaced from the pads 28 of the TAB circuit or tape 64. Upon insertion of the printhead 10 into the carrier 40, however, electrical mating engagement can occur between the pads 28 of tape 64 and the protrusions or projections 68 of the flexible printed circuit cable 60. There are numerous techniques for engagement between the contacts 68 and the pads 28, including sliding frictional engagement, and any such technique is acceptable as long as static discharge between the two connections is minimized or avoided during mating engagement or interconnection.

With reference to FIG. 5B in an installed position, the chip 11 is preferably arranged on the print surface 49 such that it is adjacent an end of the print surface, such as end (F). As can be understood from FIG. 14, if end (F) corresponds to the location on printhead 10 closest to the device for maintaining the proper paper gap (G) over the critical paper gap control region (D), such as an exit roller or star wheel 38, such an arrangement can have the dual effect of decreasing both the critical paper gap control region (D) and the minimum print margin (M) for a printer utilizing this invention. As can be further understood from FIG. 14A, utilizing a chip 11 which has a transducer length (T) that is at least as long as the interconnect length (I) of the chip and, more preferably such a chip wherein the transducer length is approximately equal to the interconnect length, the minimum print margin (M) and critical paper gap region (D) can be further improved.

Figure 14:
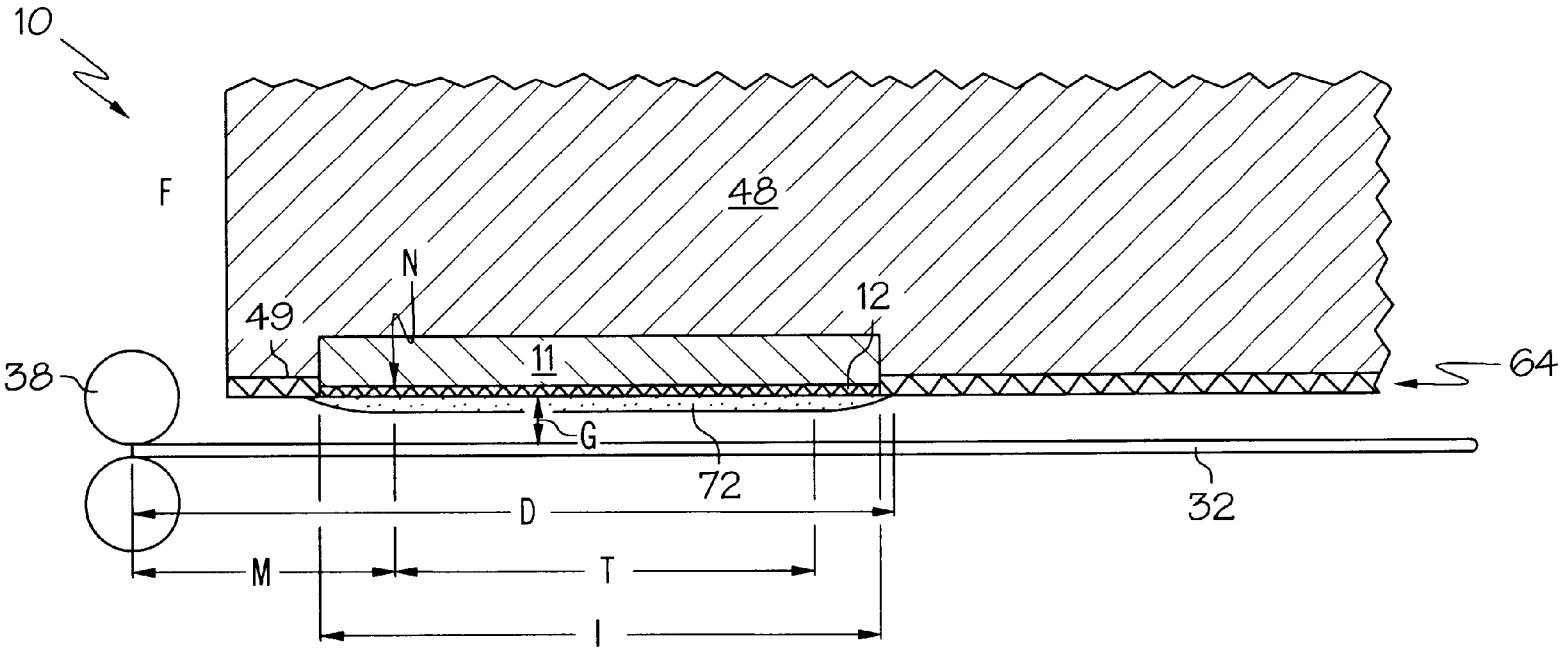
FIGS. 14, 14A, 14B, and 14C are partial cross-sectional views of inkjet printers detailing printheads according to various embodiments of the present invention and the print receiving medium passing therethrough.
Figure 14A:
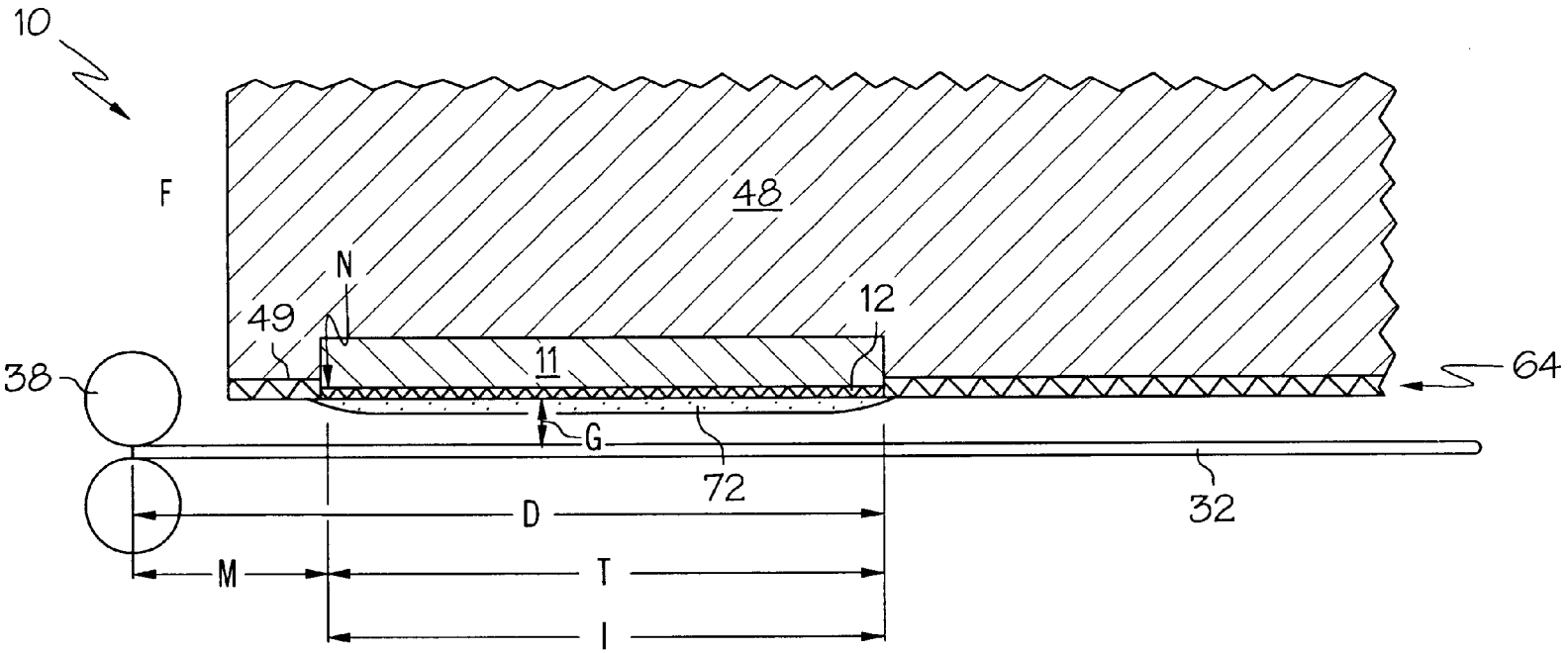
Figure 14B:
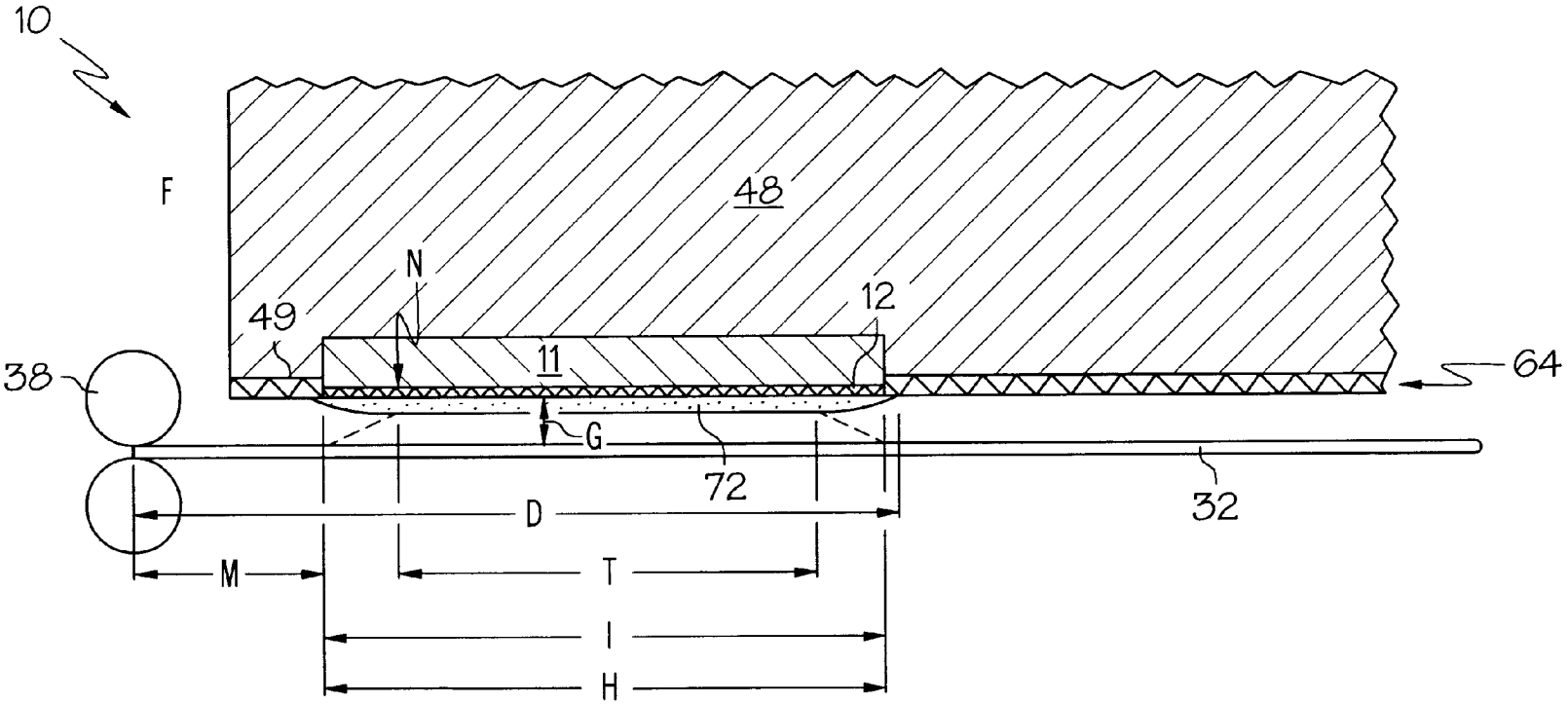
Figure 14C:
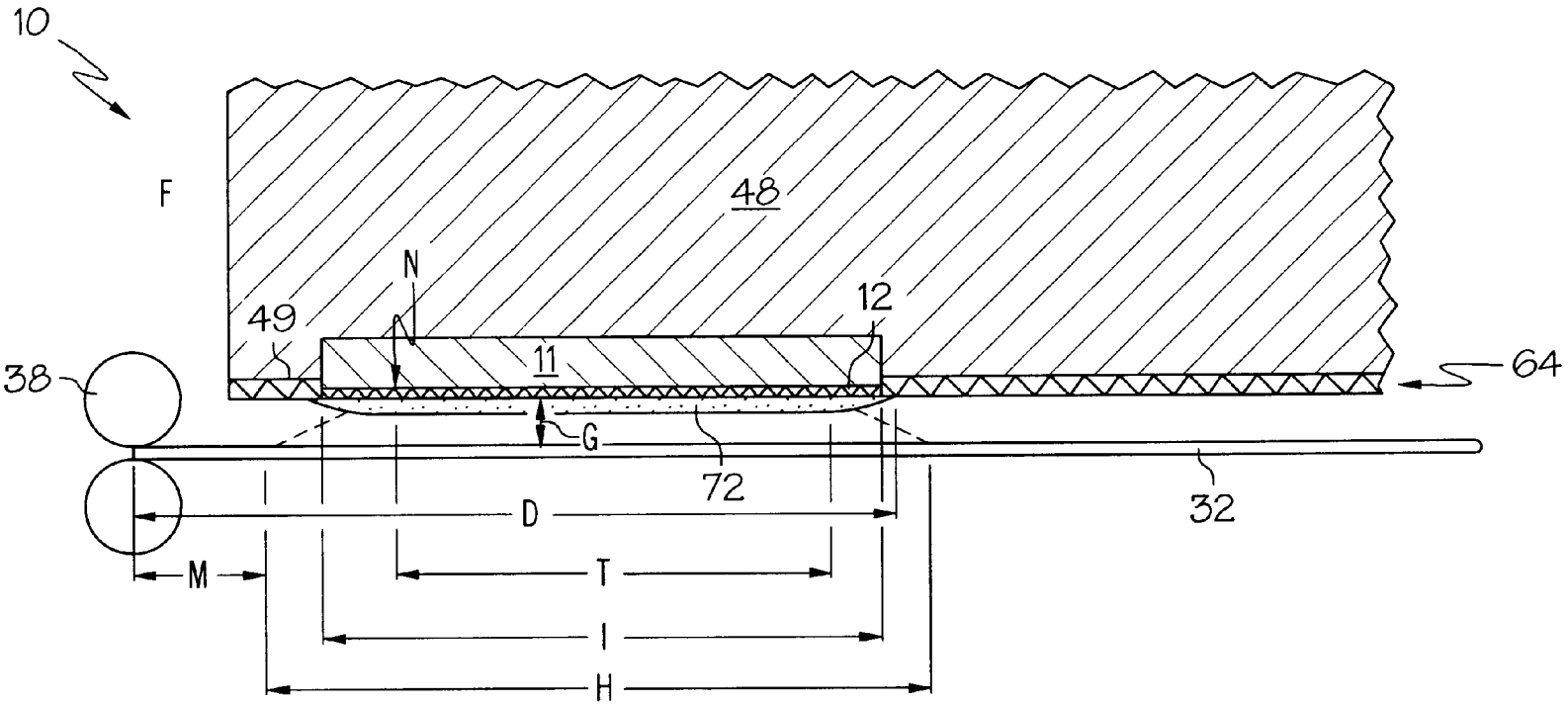

In FIGS. 14 and 14A, it was assumed that the transducer length (T) would be approximately equal to the print swath height (H). In embodiments such as that shown in FIG. 14B, it can also be understood that utilizing a printhead 10 wherein a printhead chip 11 is capable of creating a print swath height (H) at least as long as the chip interconnect length (I) will likewise improve the minimum print margin associated with that printhead chip in the printer. More preferably, the interconnect length (I) should be less than the print swath height (H) of the print chip 11.

The encapsulant areas 72 which cover, for example, the beams 71 of the TAB circuit 64, can extend along the chip 11 for an encapsulant length (A). In the various figures, this encapsulant length (A) is shown as being approximately equal to the interconnect length (I). Preferably, the printhead 10 should have a swath height (H) at least as long as the encapsulant length (A) and, more preferably, can further improve the critical paper gap control region (D) and minimum print margin (M) of the printer by utilizing a printhead chip 11 capable of creating a swath height (H) greater than the encapsulant length (A).

In the above structure, when printing occurs, simultaneously with the movement of the carrier 40 in the direction of the arrow 42 in FIGS. 3 and 4, each transducer 24 can be selectively driven with a fire pulse in accordance with recording data. During a typical fire pulse, the respective heater region (R), for example, would be exposed to a power density on the order of $10^9$ watts/meter squared, a power density greatly exceeding that of the surface of the sun. As a result, the temperature of the active heater 24 slews at a rate exceeding $10^6$ degrees Celsius per second.

The rapid heating of the ink causes explosive boiling, called nucleation. Since nucleation occurs at or near the superheat limit of the ink, the resulting vapor bubble begins to grow with an initial pressure impulse greater than 100 atmospheres. The pressure pulse imparts momentum to the fluid ink. Within several microseconds after nucleation, the vapor pressure inside the bubble is less than 1 atmosphere. The end effect is a short duration vapor bubble that displaces ink inside the chamber 18, resulting in a small droplet of ink being jetted from a nozzle 22 located above the active heater 24. The ink droplets impinge upon the surface of the print receiving media 32, wherein they form the recording information on the print receiving medium.

The foregoing description of the preferred embodiments of the present invention has been presented for purposes of illustration and description. It is not intended to be exhaustive or to limit the invention to the precise form disclosed, and modifications and variations are possible in light of the above teachings. For example, although a number of materials and shapes have been described or shown for use in the preferred embodiments of the present invention, it is to be understood that other materials and shapes could be used as alternatives to those described or shown without departing from the scope of the invention.

Thus, it should be understood that the embodiments were chosen and described in order to best illustrate the principals of the invention and its practical application. This illustration was provided to thereby enable one of ordinary skill in the art to best utilize the invention in various embodiments and with various modifications as are suited for the particular use contemplated. Accordingly, it is intended that the scope of the invention be defined by the claims appended hereto.

We claim:

1. An inkjet printhead chip comprising:

a) a silicon substrate having a surface with opposing first and second edges;

b) a plurality of transducers arranged along the first edge;

c) a plurality of interconnects arranged along the second edge; and d) driver circuitry capable of electrically connecting the transducers and the interconnects, and arranged on the substrate, wherein the chip is substantially free of interconnects between the plurality of transducers and the first edge.

2. The inkjet printhead chip according to claim 1, wherein the plurality of transducers are capable of receiving ink along the first edge.

3. The inkjet printhead chip according to claim 2, wherein the plurality of transducers are capable of receiving ink only along the first edge.

4. The inkjet printhead chip according to claim 1, wherein the plurality of transducers are arranged only along the first edge and the plurality of interconnects are arranged only along the second edge.

5. The inkjet printhead chip according to claim 1, wherein the substrate is substantially integral.

6. The inkjet printhead chip according to claim 1, wherein the driver circuitry comprises switchable addressing circuitry.

7. The inkjet printhead chip according to claim 6, wherein the switchable addressing circuitry comprises transistors.

8. The inkjet printhead chip according to claim 6, wherein the switchable addressing circuitry comprises multiplexing circuitry.

9. The inkjet printhead chip according to claim 6, wherein the switchable addressing circuitry comprises transient addressing circuitry.

10. The inkjet printhead chip according to claim 1, wherein the driver circuitry comprises a plurality of conductive leads arranged on the substrate generally perpendicular to the second edge.

11. The inkjet printhead chip according to claim 1, wherein each of the transducers is separated from adjacent transducers by less than 1/300th of an inch.

12. The inkjet printhead chip according to claim 11, wherein each of the transducers is separated from adjacent transducers by approximately 1/600th of an inch.

13. The inkjet printhead chip according to claim 1, wherein the transducers comprise heater resistors.

14. The inkjet printhead chip according to claim 1, wherein the transducers comprise piezoelectric elements.

15. The inkjet printhead chip according to claim 1, wherein the plurality of transducers extend along the first edge for a transducer length and the plurality of interconnects extend along the second edge for an interconnect length, and wherein the transducer length is at least as long as the interconnect length.

16. The inkjet printhead chip according to claim 15, wherein the transducer length is approximately equal to the interconnect length.

17. An inkjet printhead assembly, comprising:

a) a body having an ink reservoir and a print surface capable of being arranged generally parallel to a surface of a print receiving medium; and b) a printhead chip assembly arranged on the print surface and comprising:

i) a silicon substrate having a surface with opposing first and second edges, a plurality of transducers arranged along the first edge, and a plurality of interconnects arranged along the second edge;

ii) an edgefeed disposed between the first edge and the printhead body, and in fluid communication with the ink reservoir;

iii) at least one chamber in fluid communication with the edgefeed; and iv) a plate provided with a plurality of apertures, each aperture being capable of cooperating with at least one of said at least one chambers to allow ink to be ejected from said chambers.

18. The inkjet printhead assembly of claim 17, wherein the printhead chip assembly is arranged adjacent an end of the print surface.

19. The inkjet printhead assembly of claim 18, wherein the substrate surface further comprises opposing ends, one of which opposing ends is adjacent said end of the print surface.

20. The inkjet printhead assembly of claim 17, wherein the printhead chip assembly comprises only one substrate.

21. An inkjet printhead assembly, comprising:

a) a body having an ink reservoir and a print surface capable of being arranged generally parallel to a surface of a print receiving medium; and b) a printhead chip assembly arranged on the print surface and comprising:

i) a substrate having a surface with opposing first and second edges, a plurality of transducers arranged along the first edge, and a plurality of interconnects arranged along the second edge;

ii) an edgefeed disposed between the first edge and the printhead body, and in fluid communication with the ink reservoir;

iii) at least one chamber in fluid communication with the edgefeed; and iv) a plate provided with a plurality of apertures, each aperture being capable of cooperating with at least one of said at least one chambers to allow ink to be ejected from said chambers, wherein the inkjet printhead is capable of causing ink to be ejected onto the print receiving medium within a print swath height and wherein the plurality of interconnects extend along the second edge for an interconnect length, the swath height being at least as long as the interconnect length.

22. An inkjet printhead capable of causing ink to be ejected onto a print receiving medium within a print swath height, comprising:

a) a body having an ink reservoir and a print surface capable of being arranged generally parallel to a surface of a print receiving medium; and b) a printhead chip assembly arranged on the print surface adjacent an end of the print surface comprising:

i) a single, substantially integral substrate having a surface with opposing first and second edges, a plurality of transducers arranged only along the first edge, and a plurality of interconnects arranged only along the second edge, the plurality of interconnects extending along the second edge for an interconnect length less than the print swath height;

ii) an edgefeed disposed between the first edge and the printhead body, and in fluid communication with the ink reservoir;

iii) at least one chamber in fluid communication with the edgefeed; and iv) a plate provided with a plurality of apertures, each aperture being capable of cooperating with at least one of said at least one chambers to allow ink to be ejected from said chambers.

23. An inkjet printhead capable of causing ink to be ejected onto a print receiving medium within a print swath height, comprising:

a) a body having an ink reservoir and a print surface capable of being arranged generally parallel to a surface of a print receiving medium;

b) a printhead chip assembly arranged on the print surface adjacent an end of the print surface comprising:

i) a single, substantially integral substrate having a surface with opposing first and second edges, a plurality of transducers arranged only along the first edge, and a plurality of interconnects arranged only along the second edge, the plurality of interconnects extending along the second edge for an interconnect length less than the print swath height;

ii) an edgefeed disposed between the first edge and the printhead body, and in fluid communication with the ink reservoir;

iii) at least one chamber in fluid communication with the edgefeed; and iv) a plate provided with a plurality of apertures, each aperture being capable of cooperating with at least one of said at least one chambers to allow ink to be ejected from said chambers; and c) an encapsulant covering the plurality of interconnects and extending along the second edge for an encapsulant length.

24. The inkjet printhead of claim 23, wherein the print swath height is at least as long as the encapsulant length.

25. An inkjet printhead assembly, comprising:

a) a body having an ink reservoir and a print surface capable of being arranged generally parallel to a surface of a print receiving medium; and b) a printhead chip assembly arranged on the print surface and comprising:

i) a silicon substrate having a surface with opposing first and second edges, a plurality of transducers arranged along the first edge, and a plurality of interconnects arranged along the second edge;

ii) an edgefeed disposed between the first edge and the printhead body, and in fluid communication with the ink reservoir;

iii) at least one chamber in fluid communication with the edgefeed; and iv) a plate provided with a plurality of apertures, each aperture being capable of cooperating with at least one of said at least one chambers to allow ink to be ejected from said chambers; and wherein the inkjet printhead is capable of causing ink to be ejected onto the print receiving medium within a print swath height and wherein the plurality of interconnects extend along the second edge for an interconnect length, and wherein the interconnect length is less than the swath height.

26. The inkjet printhead assembly of claim 25, wherein the swath height is at least as long as the encapsulant length.

27. The inkjet printhead assembly of claim 26, wherein the encapsulant length is less than the swath height.

28. An inkjet printhead assembly, comprising:

a) a body having an ink reservoir and a print surface capable of being arranged generally parallel to a surface of a print receiving medium; and b) a printhead chip assembly arranged on the print surface and comprising:

i) a silicon substrate having a surface with opposing first and second edges, a plurality of transducers arranged along the first edge, and a plurality of interconnects arranged along the second edge;

ii) an edgefeed disposed between the first edge and the printhead body, and in fluid communication with the ink reservoir;

iii) at least one chamber in fluid communication with the edgefeed; and iv) a plate provided with a plurality of apertures, each aperture being capable of cooperating with at least one of said at least one chambers to allow ink to be ejected from said chambers;

v) an encapsulant generally covering the plurality of interconnects and extending along the second edge for an encapsulant length; and wherein the inkjet printhead is capable of causing ink to be ejected onto the print receiving medium within a print swath height and wherein the plurality of interconnects extend along the second edge for an interconnect length, the swath height being at least as long as the interconnect length.

* * * * *